US011697786B2

(12) United States Patent
Doi et al.

(10) Patent No.: US 11,697,786 B2
(45) Date of Patent: Jul. 11, 2023

(54) GREASE COMPOSITION

(71) Applicant: NIPPON GREASE CO., LTD., Osaka (JP)

(72) Inventors: Satoshi Doi, Kobe (JP); Akihiro Yamamoto, Kobe (JP); Jusei Maeda, Kobe (JP)

(73) Assignee: NIPPON GREASE CO., LTD., Osaka (JP)

( * ) Notice: Subject to any disclaimer, the term of this patent is extended or adjusted under 35 U.S.C. 154(b) by 0 days.

(21) Appl. No.: 16/978,046

(22) PCT Filed: Mar. 5, 2019

(86) PCT No.: PCT/JP2019/008693
§ 371 (c)(1),
(2) Date: Sep. 3, 2020

(87) PCT Pub. No.: WO2019/172275
PCT Pub. Date: Sep. 12, 2019

(65) Prior Publication Data

US 2021/0040413 A1 Feb. 11, 2021

(30) Foreign Application Priority Data

Mar. 6, 2018 (JP) ..... JP2018-039904

(51) Int. Cl.

| | |
|---|---|
| ***C10M 169/06*** | (2006.01) |
| ***C10M 107/24*** | (2006.01) |
| ***C10M 109/00*** | (2006.01) |
| ***C10M 113/06*** | (2006.01) |
| ***C10M 115/08*** | (2006.01) |
| ***C10M 123/02*** | (2006.01) |
| ***C10M 129/74*** | (2006.01) |
| ***C10M 135/10*** | (2006.01) |
| ***C10M 141/08*** | (2006.01) |
| ***C10M 143/06*** | (2006.01) |
| ***C10M 161/00*** | (2006.01) |
| ***C10M 169/04*** | (2006.01) |
| *C10N 20/00* | (2006.01) |
| *C10N 10/02* | (2006.01) |
| *C10N 30/12* | (2006.01) |
| *C10N 40/32* | (2006.01) |

(52) U.S. Cl.

CPC ..... *C10M 169/06* (2013.01); *C10M 107/24* (2013.01); *C10M 109/00* (2013.01); *C10M 113/06* (2013.01); *C10M 115/08* (2013.01); *C10M 123/02* (2013.01); *C10M 129/74* (2013.01); *C10M 135/10* (2013.01); *C10M 141/08* (2013.01); *C10M 143/06* (2013.01); *C10M 161/00* (2013.01); *C10M 169/04* (2013.01); *C10M 2201/056* (2013.01); *C10M 2205/026* (2013.01); *C10M 2207/283* (2013.01); *C10M 2215/28* (2013.01); *C10M 2219/044* (2013.01); *C10M 2290/00* (2013.01); *C10M 2290/04* (2013.01); *C10M 2290/10* (2013.01); *C10N 2010/02* (2013.01); *C10N 2020/065* (2020.05); *C10N 2020/067* (2020.05); *C10N 2020/081* (2020.05); *C10N 2030/12* (2013.01); *C10N 2040/32* (2013.01)

(58) Field of Classification Search

CPC C10M 141/08; C10M 117/00; C10M 129/76; C10M 169/06; C10M 115/08; C10M 129/74; C10M 135/10; C10N 2010/02; C10N 2010/04; C10N 2010/06

See application file for complete search history.

(56) References Cited

U.S. PATENT DOCUMENTS

| | | | | |
|---|---|---|---|---|
| 2009/0136170 | A1 | 5/2009 | Sato | |
| 2014/0256605 | A1 * | 9/2014 | Bertin | C10M 177/00 508/178 |
| 2016/0208194 | A1 | 7/2016 | Matsumoto | |

FOREIGN PATENT DOCUMENTS

| | | | |
|---|---|---|---|
| CN | 102433195 | A | 5/2012 |
| CN | 105492585 | A | 4/2016 |
| CN | 105567386 | A | 5/2016 |
| EP | 3018192 | A1 | 5/2016 |
| EP | 3042945 | A1 | 7/2016 |
| JP | 2004-099847 | A | 4/2004 |
| JP | 2006-182856 | A | 7/2006 |
| JP | 2016-089040 | A | 7/2006 |
| JP | 2006-528996 | A | 12/2006 |
| JP | 2007-070461 | A | 3/2007 |
| JP | 2007-084620 | A | 4/2007 |

(Continued)

OTHER PUBLICATIONS

International Search Report of the International Searching Authority for International Application Mo. PCT/JP2019/008693 dated Jun. 4, 2019 (2 sheets).

(Continued)

*Primary Examiner* — Vishal V Vasisth

(74) *Attorney, Agent, or Firm* — Kratz, Quintos & Hanson, LLP

(57) ABSTRACT

An object of the present invention is to provide a grease composition which has little influence on the environment and has good rust prevention and water resistance against salt water such as sea water. The grease composition comprises a biodegradable base oil and a rust-preventive agent comprising a calcium sulfonate complex and a sorbitan fatty acid ester, wherein a total content of biodegradable organic substances in the grease composition is 75% by mass or more, and wherein a content of the rust-preventive agent is 2.5 to 30% by mass.

11 Claims, No Drawings

(56) References Cited

FOREIGN PATENT DOCUMENTS

| | | | |
|---|---|---|---|
| JP | 2008-001864 | A | 1/2008 |
| JP | 2013060541 | A | 4/2013 |

OTHER PUBLICATIONS

Office Action of Chinese Patent Application No. 201980014428.2 dated Dec. 17, 2021 (10 sheets, 8 sheets translation, 18 sheets total).
Extended European Search Report for corresponding European Patent Application No. 19763914.9 dated Oct. 22, 2021 (9 sheets).
JIS K 2220; "Lubricating grease"; Japanese Industrial Standard; Japanese Standards Association; Tokyo, Japan; 2013 (pp. 1-16, 8 cover sheets, 1 appendix sheet, 25 sheets total).

* cited by examiner

GREASE COMPOSITION

This application is a 371 of PCT/JP2019/008693, filed Mar. 5, 2019.

TECHNICAL FIELD

The present invention relates to a grease composition which has little influence on the environment and has rust prevention and water resistance against salt water.

BACKGROUND ART

Recently, there has been a growing interest in protection of water resources and the marine environment. For example, the United States put into force Vessel General Permit: VGP to mandate use of Environmentally Acceptable Lubricants; EAL, which biodegradability, non-toxicity and non-bioaccumulativity are recognized, for a water contact part that may leak oil, with respect to an equipment using oil, in all the incoming vessels. Under such circumstances, there is a pressing need to develop a biodegradable grease for the purpose of prevention of pollution of the ocean, lakes and marshes, rivers, etc.

Patent Document 1 discloses a lubricant composition which is suitable for a wire rope that comes into contact with water and is safe for a human body. However, there is room for improvement in high rust prevention and water resistance against salt water such as sea water.

PRIOR ART DOCUMENT

Patent Document

Patent Document 1: JP 2013-060541 A

SUMMARY OF THE INVENTION

Problem to be Solved by the Invention

An object of the present i is to provide a grease composition which has little influence on the environment and has good rust prevention and water resistance against salt water such as sea water.

Means to Solve the Problem

As a result of intensive studies, the present inventors have found that a grease composition comprising a biodegradable base oil, a thickener, and a rust-preventive agent comprisings a calcium sulfonate complex and a sorbitan fatty acid ester, has good rust prevention and water resistance against salt water, and have completed the present invention.

That is, the present invention relates to

[1] A grease composition comprising a biodegradable base oil and a rust-preventive agent comprising a calcium sulfonate complex and a sorbitan fatty acid ester, wherein a total content of biodegradable organic substances in the grease composition is 75% by mass or more, and a content of the rust-preventive agent is 2.5 to 30% by mass,

[2] The grease composition of [1], wherein a content of the calcium sulfonate complex with respect to the sorbitan fatty acid ester content of the calcium sulfonate complex/a content of the sorbitan fatty acid ester) is 0.5 to 5.0,

[3] The grease composition of [1] or [2], comprising a biodegradable base oil, a thickener, and a rust-preventive agent comprising a calcium sulfonate complex and a sorbitan fatty acid ester, wherein a total content of biodegradable organic substances in the grease composition (particularly, the biodegradable base oil and the sorbitan fatty acid ester) is 75% by mass or more, and a content of the rust-preventive agent is 2.5 to 30% by mass,

[4] The grease composition of [3], wherein a content of the thickener is 2.0 to 20% by mass,

[5] The grease composition of [3] or [4], wherein the thickener is one or more selected from the group consisting of a lithium soap, a lithium composite soap, and a urea-based compound,

[6] The grease composition of any of [3] to [5], wherein a worked penetration of the grease composition is 265 to 295,

[7] The grease composition of [1] or [2], comprising a biodegradable base oil, a biodegradable wax, a tackiness agent, and a rust-preventive agent comprising a calcium sulfonate complex and a sorbitan fatty acid ester, wherein the total content of biodegradable organic substances in the grease composition (particularly, the biodegradable base oil, the biodegradable wax and the sorbitan fatty acid ester) is 5% by mass or more, a content of the rust-preventive agent is 2.5 to 30% by mass, and a melting point of the grease composition is 50 to 100° C.,

[8] The grease composition of [7], wherein a content of the tackiness agent is 1.0 to 25% by mass, and

[9] The grease composition of [7] or [8], wherein a content of the biodegradable wax in a total amount of the biodegradable base oil and the biodegradable wax is 6.0 to 40% by mass.

Effects of the Invention

The grease composition of the present invention has little influence on the environment and has good rust prevention and water resistance against salt water such as sea water. It also has a low risk of toxicity and accumulative property against living organisms since it does not use a metal-based additive such as zinc and molybdenum used in a common grease.

EMBODIMENT FOR CARRYING OUT THE INVENTION

<Grease Composition>

The grease composition according to the present embodiment is characterized by comprising a biodegradable base oil and a rust-preventive agent comprising a calcium sulfonate complex and a sorbitan fatty acid ester. In addition, the above-described VGP regulates to contain 75% or more of organic substances having a predetermined degree of biodegradability (for example, biodegradability of 60% or more by microorganisms, conforming to the OECD test guideline 301B) in the grease composition, conforming to the OECD test guideline 301 series, a standard test method for measuring ready biodegradability of organic substances, and the grease composition according to the present embodiment is designed to comply with VGP.

(Base Oil)

As a base oil, a base oil which is determined to have biodegradability, having a predetermined degree of biodegradability, is appropriately used conforming to the OECD test guideline 301 series (hereinafter, such base oil may be simply described here as a "biodegradable base oil").

Examples of the biodegradable base oil include, but not particularly limited to, a vegetable oil, an animal oil, a synthetic ester oil, polyalkylene glycol, a synthetic hydrocarbon oil and the like. Among them, the synthetic ester oil and the vegetable oil are preferable to from the viewpoints of rust prevention and water resistance. The synthetic ester oil is also preferable from the viewpoints of oxidation stability and storage stability at a high temperature, and the vegetable oil is also preferable from the viewpoints of cost, high biodegradability, and safety for such as toxicity and accumulative property.

In the present specification, the "vegetable oil" is an oil derived from a plant and is a concept including an oil and fat. Examples of the vegetable oil that can be used in the present embodiment include, but not particularly limited to, for example, a cocoa butter oil, a corn oil, a peanut oil, a sunflower oil, a soybean oil, a fractionated coconut oil, an olive oil, a camellia oil, a safflower oil, a tung oil, a linseed oil, a coconut oil, an oak oil, an almond oil, an apricot kernel oil, a castor oil, a rapeseed oil, a chaulmoogra oil, a cinnamon oil, a cottonseed oil, a sesame oil, a palm oil, a palm kernel oil, a rice bran oil, a chinese wood oil, a turpentine oil, a kapok oil, etc. The vegetable oil is preferably one or more selected from the group consisting of a corn oil, a sunflower oil, a safflower oil, a castor oil, a linseed oil, a soybean oil, a rapeseed oil, a cottonseed oil, an olive oil, a camellia oil, a chinese wood oil, a turpentine oil, a fractionated coconut oil and a palm oil. It may also be a mixture of a plurality of these oils, an oil and fat containing diglyceride or monoglyceride, or an oil partially modified such as oxidized or reduced.

Examples of a commercially available vegetable oil include, but not limited to, for example, a vegetable oil manufactured by Marusho Co., Ltd. such as a soybean oil KT, a vegetable oil manufactured by The Nisshin OilliO Group, Ltd. such as a soybean shirashime oil and a linseed oil, a vegetable oil manufactured by Boso oil and fat Co., Ltd. such as a rice salad oil, a vegetable oil manufactured by Cognis Japan Ltd. such as TEXAPRINTSDCE, a vegetable oil manufactured by AZUCHI. co Ltd such as a limonene oil, an eucalyptus oil, and a chinese wood oil, a vegetable oil manufactured by Harima Chemicals Group, Inc. such as HARTALL SR-20, HARTALL SR-30, HARTALL R-20, a turpentine oil manufactured by Arakawa Chemical Industries, Ltd. such as α-pinene, Toyo Matsujirushi, dipentene, a Castor Oil No.1 manufactured by Hokoku Corporation, etc.

In the present specification, the "animal oil" is an oil derived from an animal and is a concept including an oil and fat. The examples of the animal oil that can be used in the present embodiment include fish oils obtained from bodies of fishes such as a sardine oil, a mackerel oil, a herring oil, a saury oil, a tuna oil, and a cod liver oil, lard fat, a chicken fat, a butter fat, a beef tallow, a beef bone fat, a deer fat, a dolphin fat, a horse fat, a pork fat, a bone oil, a sheep fat, a neat's foot oil, a porpoise oil, a shark oil, a sperm whale oil, a whale oil, etc. The animal oil is preferably one or more selected from the group consisting of a fish oil, a beef tallow, and lard, and may be a mixture of a plurality of these oils, an oil and fat containing diglyceride or monoglyceride, or an oil partially modified such as oxidized or reduced.

As a synthetic ester oil, a fatty acid diester and a fatty acid polyol ester are appropriately used, and the fatty acid polyol ester is more preferable. Specific examples of the fatty acid diester include, for example, diisodecyl adipate, diisodecyl azelate, dioctyl sebacate, and the like. Specific examples of the fatty acid polyol ester include, for example, neopentyl glycol diester, trimethylolpropane triester, to trimethylolpropane complex ester, pentaerythritol tetraester, dipentaerythritol hexaester, and the like. Among them, highly biodegradable ester oils such as Synative ES TMP 05/140 and 05/320 (trimethylol propane complex ester) manufactured by BASF Japan Ltd., Priolube 2089 (trimethylol propane oleate) manufactured by Croda Japan KR, and MINERASOL LB-601 (a special castor oil-based condensed fatty acid ester) manufactured by ITOH OIL CHEMICALS CO., LTD. are appropriately used.

Examples of polyalkylene glycol include, for example, polyethylene glycol, polypropylene glycol, polyethylene oxide-propylene oxide (copolymer of ethylene oxide and propylene oxide), poly(methyl-ethylene) glycol, polybutylene glycol and the like. Further, as polyalkylene glycol, any of a random copolymer, an alternating copolymer, and a block copolymer of polyalkylene glycols obtained by using two or more different alkylene oxides, and a mixture thereof can be used.

Examples of the synthetic hydrocarbon oil include, for example, a FT synthetic oil and the like. In the present specification, the "FT synthetic oil" means a synthetic oil consisting of liquid fractions equivalent to naphtha, kerosene, and light oil obtained by applying a Fischer-Tropsch (FT) reaction to a mixed gas (sometimes referred to as a synthetic gas) containing hydrogen and carbon monoxide as main components, a hydrocarbon mixture obtained by hydro-refining and hydrocracking them, and a hydrocarbon mixture obtained by producing liquid fractions and a FT wax by the FT reaction and hydro-refining and hydrocracking them. In addition, the FT synthetic oils are often given names according to their raw materials, for example, those that use natural gas as a raw material are referred to as GTL, those that use coal as a raw material are referred to as CTL, and those that use biomass as a raw material are referred to as BTL.

As the above-described biodegradable base oil, any one of the above-exemplified base oils may be used alone, or two or more thereof may be used in combination. Preferably, one or more synthetic ester oils or a base oil in which one or more vegetable oils are mixed therewith is used. By using two or more of biodegradable base oils in combination, improvement in lubricity can be expected.

A content of the biodegradable base oil is preferably 60% by mass or more, more preferably 65% by mass or more, more preferably 70% by mass or more, further preferably 75% by mass or more, and particularly preferably 80% by mass or more in the grease composition.

Further, as a base oil, regular base oils used for the grease composition, which are determined not to have a predetermined biodegradability conforming to the OECD test guideline 301 series, may be used in combination for improving lubricity, etc. However, the content of such base oil is required to be less than 25% by mass in the grease composition as total organic substances having a predetermined biodegradability conforming to the OECD test guideline 301 series.

A flash point of the base oil is preferably 230° C. or higher, and more preferably 260° C. or higher. When the flash point of the base oil is 230° C. or higher, the grease composition is unlikely to catch fire. In addition, in the present embodiment, the flash point of the base oil can be calculated by the Cleveland Open-Cup (COC) of JIS K 22645 4.

A kinematic viscosity (40° C.) of the base oil is preferably 70 $mm^2/s$ or more, and more preferably 90 $mm^2/s$ or more. A kinematic viscosity (40° C.) of the base oil is also preferably 1,000 $mm^2/s$ or less, and more preferably 600 $mm^2/s$ or less. When the kinematic viscosity of the base oil is within the above-described ranges, the flash point of the base oil is easily maintained at a high temperature, and the grease composition has a good fluidity (pumpability). In addition, in this embodiment, the kinematic viscosity of the base oil can be calculated by JIS K 2283.

(Rust-Preventive Agent)

As a rust-preventive agent in the present embodiment, a calcium sulfonate complex and a sorbitan fatty acid ester are appropriately used. By using the calcium sulfonate complex and the sorbitan fatty acid ester in combination, a synergistic rust preventive effect can be obtained.

The calcium sulfonate complex is a combination of calcium sulfonate, and a calcium salt (calcium soap) selected from (i) calcium carbonate, (ii) a higher fatty acid calcium salt such as calcium dibehenate, calcium distearate, and calcium dihydroxy stearate, (iii) a lower fatty acid calcium salt such as calcium acetate, and (iv) calcium borate and the like. Among them, those which contain calcium sulfonate and calcium carbonate as essential components, and in which at least two selected from the group consisting of calcium dibehenate, calcium distearate, calcium dihydroxy stearate, calcium borate and calcium acetate are compounded with these components, are preferable. Specific examples of the calcium sulfonate complex include, for example, commercially available products under the trade names of Daphne Multilex WR manufactured by Idemitsu Kosan Co., Ltd., RENOLIT CXI 1 manufactured by Fuchs Japan Ltd., Calforex manufactured by Nippeco Ltd., etc.

In addition, the base number of calcium sulfonate is preferably not less than 50 mgKOH/g and not more than 500 mgKOH/g, and more preferably not less than 300 mgKOH/g and not more than 500 mgKOH/g, from the viewpoint of thickening effect. Specifically, dialkylbenzenesulfonic acid calcium salt is particularly preferable.

Examples of the sorbitan fatty acid ester include, for example, sorbitan monooleate, sorbitan trioleate, sorbitan monolaurate, sorbitan tristearate, sorbitan monostearate, sorbitan monopalmitate, polyoxyethylene sorbitan monolaurate, polyoxyethylene sorbitan monooleate, polyoxyethylene sorbitan monostearate, and the like. As a sorbitan fatty acid ester, for example, a sorbitan fatty acid ester commercially available from Kao Corporation under the trade name of Eniazole, etc. can be used. In addition, the sorbitan fatty acid ester is a biodegradable organic substance conforming to the OECD test guideline 301 series. In particular, since sorbitan monooleate is a substance regulated by the regulation "FDA21.CFR1.785.3570", it is highly safe for a human body as long as the defined specified value is kept. The sorbitan fatty acid ester preferably has a saponification value of 145 to 160 and a hydroxyl value of 193 to 210. When the saponification value and the hydroxyl value are out of the range of 193 to 210, it becomes difficult to ensure safety as a food ingredient. In addition, the sorbitan fatty acid ester is a biodegradable organic substance conforming to the OECD test guideline 301 series. In particular, since sorbitan monooleate is a substance regulated by the regulation "FDA21CFR1785.3570", it is highly safe for a human body as long as the defined specified value is kept. The sorbitan fatty acid ester preferably has a saponification value of 145 to 160 and a hydroxyl value of 193 to 210. When the saponification value and the hydroxyl value are out of the range of 193 to 210, it becomes difficult to ensure safety as a food ingredient.

A content of the calcium sulfonate complex with respect to the sorbitan fatty acid ester (the content of the calcium sulfonate complex/the content of the sorbitan fatty acid ester) is preferably in the range of 0.5 to 5.0, more preferably in the range of 0.7 to 3.0, and further preferably in the range of 1.0 to 2.0. If it is less than 0.5 or more than 5.0, the synergistic effect of rust prevention tends to be weakened.

The rust-preventive agent may appropriately include other rust-preventive agents as well as the above-mentioned calcium sulfonate complex and sorbitan fatty acid ester. Examples of the other rust-preventive agents include, for example, sulfonate, carboxylic acid, a carboxylic acid salt, an ester-based rust-preventive agent, an amine-based rust-preventive agent, and the like. Any one of the other rust-preventive agents exemplified above may be used alone, or two or more thereof may be used in combination.

Sulfonate is a sulfonate metal salt such as a sulfonate alkali metal salt and a sulfonate alkaline earth metal salt, or a sulfonate amine salt, etc. Sulfonate can be prepared by reacting an alkali metal, an alkaline earth metal or amine with a sulfonic acid.

As a sulfonic acid constituting sulfonate, a petroleum sulfonic acid and a dinonylnaphthalene sulfonic acid are preferable. Examples of the alkali metal constituting sulfonate include sodium, potassium, and the like. Examples of the alkaline earth metal include magnesium, calcium, barium, and the like. Among them, as a metal salt, a sodium salt, a potassium salt, a calcium salt or a barium salt is preferable, and the calcium salt is more preferable. In addition, when sulfonate is an amine salt, examples of amine include monoamine, polyamine, alkanolamine, and the like.

Among sulfonates, amine sulfonate, calcium sulfonate, or barium sulfonate is preferably included, calcium sulfonate is more preferably included, and a petroleum sulfonate calcium salt is further preferably included. In addition, any one of the sulfonates exemplified above may be used alone, or two or more thereof may be used in combination.

Examples of carboxylic acid include, for example, monocarboxylic acids such as stearic acid, alkylsuccinic acid and its derivatives, alkenylsuccinic acid and its derivatives, naphthenic acid, abietic acid, lanolin fatty acid, and the like. Examples of the carboxylic acid salt include the above-described metal salts of carboxylic acids (calcium, barium, magnesium, aluminum, zinc, lead, etc.).

Examples of the ester-based rust-preventive agent include, for example, polyoxyethylene laurate, polyoxyethylene oleate, polyoxyethylene stearate, pentaerythritol monooleate, carboxylic acid partial esters such as succinic acid half ester, and the like. The ester-based rust-preventive agent is appropriately used since it has a good biodegradability.

Examples of the amine-based rust-preventive agent include, for example, amine derivatives such as alkoxyphenylamine, dibasic carboxylic acid partial amides, and the like.

A content of the rust-preventive agent is 2.5% by mass or more, preferably 3.0% by mass or more, and more preferably 4.0% by mass or more in the grease composition. When the content of the rust-preventive agent is less than. 2.5% by mass, the rust prevention against salt water tends to decrease. On the other hand, from the viewpoint of reducing non-biodegradable organic substances, the content of the rust-preventive agent is 30% by mass or less, preferably 25% by mass or less, more preferably 20% by mass or less, and further preferably 15% by mass or less.

The grease composition according to one embodiment of the present invention comprises a biodegradable base oil, a thickener, and a rust-preventive agent comprising a calcium sulfonate complex and a sorbitan fatty acid ester. The grease composition in such compound has a good handleability and storage stability and is appropriately used for maintenance of wire ropes and the like.

(Thickener)

As the thickener in the present embodiment, a lithium soap is appropriately used from the viewpoint that it has no major disadvantage and has a good performance balance (for example, water resistance, shear stability, etc.). Examples of the lithium soap include, for example, a lithium soap synthesized from a C10-C28 fatty acid and a C10-C28 hydroxy acid, and the like.

Examples of the C10-C28 fatty acid include lauric acid, palmitic acid, stearic acid, linoleic acid, arachidic acid, myristic acid, pentadecanoic acid, heptadecanoic acid, oleic acid, arachidonic acid behenic acid, and the like. Among them, stearic acid is preferable from the viewpoint of a good consistency yield (a degree of hardening of grease). Examples of the C10-C28 hydroxy acid include 12-hydroxystearic acid, 12-hydroxylauric acid, 16-hydroxypalmitic acid, and the like. Among them, 12-hydroxystearic acid is preferable from the viewpoint that it is easily available and inexpensive.

More specifically, examples of the lithium soap include, for example, lithium laurate, lithium stearate, lithium 12-hydroxystearate, and a mixture thereof, etc. As the lithium soap, any one of the above-described lithium soaps may be used alone, or two or more thereof may be used in combination.

Examples of thickeners other than lithium soaps include, for example, a urea-based compound, metal soaps such as a lithium composite soap, a calcium soap, a sodium soap, and an aluminum soap, a sodium terephthalamate, a fluorine, an organized bentonite, a silica gel, and the like. Among them, the urea-based compound and the lithium composite soap are preferred. More preferably, the thickener comprises a lithium soap, and more preferably, the thickener only consists of a lithium soap.

The lithium composite soap is not particularly limited. By way of an example, the lithium composite soap uses lithium as a metal source and includes those formed by reaction with a C12-C24 aliphatic monocarboxylic acid, a C2-C12 aliphatic dicarboxylic acid, and lithium hydroxide, having at least one hydroxy group, preferably those formed by reaction with a mixture of 12-hydroxystearic acid and azelaic acid to with lithium hydroxide.

The urea-based compound is not particularly limited. By way of an example, the urea-based compound is a diurea compound represented by the following general formula (1), wherein $R^2$ is a C6-C15 aromatic hydrocarbon group, and $R^1$ and $R^3$ represent a C6-C18 aromatic hydrocarbon group, a cyclohexyl group, a C7-C12 alkyl cyclohexyl group, or a C8-C22 alkyl group.

[Chemical Formula 1]

General Formula (I)

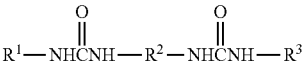

The diurea compound can be obtained by reacting amine with a diisocyanate compound by a known method. Examples of amine include, for example, a C6-C18 aromatic amine, cyclohexylamine, a C7-C12 alkylcyclohexylamine, a C8-C22 alkylamine, and a mixture thereof, etc. Examples of the diisocyanate compound include, for example, 4,4'-diphenylmethane diisocyanate, 2,4-tolylene diisocyanate, 2,6-tolylene diisocyanate, and the like. Among them, 4,4'-diphenyl ethane diisocyanate and 2,6-tolylene diisocyanate are preferable from the viewpoint of their good availability, and 4,4'-diphenylmethane diisocyanate is also preferable from the viewpoint of its good heat resistance.

Although a content of the thickener is not particularly limited, it is preferably 2.0% by mass or more, more preferably 5.0% by mass or more, and further preferably 8.0% by mass or more in the grease composition. When the content of the thickener is less than 2.0% by mass, the grease composition obtained is too soft and thus tends to scatter, leak, or cause excessive oil separation. On the other hand, from the viewpoint of reducing non-biodegradable organic substances, the content of the thickener is preferably 20% by mass or less, more preferably 18% by mass or less, further preferably 15% by mass or less, and particularly preferably 12% by mass or less.

In addition, in an aspect of using the thickener, an amount of the tackiness agent (particularly, polyisobutylene) used is preferably less than 1.0% by mass, more preferably less than 0.5% by mass, and further preferably less than 0.1% by mass, and it is particularly preferable not to use a tackiness agent. When the amount of the tackiness agent used is 1.0% by mass or more, the viscosity of the grease becomes high, and the handleability may decrease due to stringing or the like.

From the viewpoint of handling, the worked penetration of the grease composition according to the present embodiment is preferably in the range of 220 to 340, and more preferably 265 to 295 (No. 2). In addition, in the present embodiment, a value of the worked penetration is determined by multiplying by 10 a depth (mm) reached by dropping a cone attached to a penetration meter into the grease composition and penetrating it therethrough for 5 seconds under the environment of 25° C. according to JIS K. 2220 7.

The grease composition according to another embodiment of the present invention comprises a biodegradable base oil, a biodegradable wax, a tackiness agent, and a rust-preventive agent comprising a calcium sulfonate complex and a sorbitan fatty acid ester, and has a melting point of 50° C. to 100° C. Such grease composition is particularly suitable for producing a wire rope. When the melting point is lower than 50° C., there is a problem that the grease drips off from the wire rope when used at a high temperature. On the other hand, when the melting point is higher than 100° C., there are problems that deterioration of oil agent tends to be accelerated and that application in a manufacturing line of the wire rope becomes difficult, etc. The melting point is preferably 55° C. to 95° C., more preferably 60° C. to 90° C., and further preferably 65° C. to 85° C. In addition, in the above-described grease composition comprising the thickener, if heating and melting and then cooling are repeated, it may lead to inability of maintaining the condition as grease such as softening of grease and oil separation, and additives may deteriorate and rust prevention may decrease. However, in the grease composition of the present embodiment comprising a biodegradable wax and a tackiness agent, even if it is cooled down after heating and melting, the grease state and rust prevention can be maintained.

(Wax)

As a wax, a wax which is determined to have biodegradability, having a predetermined degree of biodegradability, is appropriately used conforming to the OECD test guideline 301 series (hereinafter, such wax may be simply described here as a "biodegradable wax"). The biodegradable wax can be used as a substitute for the biodegradable base oil and can be contained in an appropriate amount to adjust the melting point of the grease composition to the above-described ranges.

As the biodegradable wax, a known plant-based wax, animal-based wax, petroleum-based wax and the like can be used. Examples of the plant-based wax include, for example, a rice wax, a carnauba wax, a candelilla wax and the like. Examples of the animal-based wax include, for example, beeswax, lanolin, a spermaceti wax, and the like. Examples of the petroleum-based wax include, for example, a microcrystalline wax, a paraffin wax and the like. Further, even a synthetic wax having biodegradability can be used.

A total content of the biodegradable base oil and the biodegradable wax is preferably 60% by mass or more, more preferably 65% by mass or more, more preferably 70% by mass or more, further preferably 75% by mass % or more, and particularly preferably 80% by mass or more in the grease composition.

A content of the biodegradable wax in a total amount of the biodegradable base oil and the biodegradable wax is preferably 6.0% by mass or more, more preferably 6.5% by mass or more, further preferably 10% by mass or more, and particularly preferably 12% by mass or more. Further, the content is preferably 40% by mass or less, more preferably 35% by mass or less, further preferably 30% by mass or less, and particularly preferably 25% by mass or less.

(Tackiness Agent)

The tackiness agent that can be used in the present embodiment is not particularly limited, and those generally used in a lubricating grease, such as polybutene, polyisobutene, polyisobutylene, and alpha-olefin copolymer, can be appropriately selected. The tackiness agent may be a tackiness agent which is determined to have biodegradability, having a predetermined degree of biodegradability, conforming to the OECD test guideline 301 series (e.g., polyisobutylene etc.).

A content of the tackiness agent is preferably 1.0% by mass or more, more preferably 3.0% by mass or more, further preferably 5.0% by mass or more, and particularly preferably 7.0% by mass or more in the grease composition. Further, the content of the tackiness agent is preferably 25% by mass or less, more preferably 20% by mass or less, further preferably 15% by mass or less, and particularly preferably 12% by mass or less. When the content of the tackiness agent is within the above-described ranges, there is an advantage that the adhesiveness improves without affecting the pumpability.

In addition, in an aspect of using a biodegradable wax and a tackiness agent, an amount of the thickener (particularly an aluminum composite soap) used is preferably less than 1.0% by mass, more preferably less than 0.5% by mass, and further preferably less than 0.1% by mass, and it is particularly preferable not to use a thickener. When the amount of the thickener used is 1.0% by mass or more, repeated heating and melting and then cooling may lead to inability of maintaining the condition as grease such as softening of grease and oil separation, and additives may deteriorate and rust prevention may decrease.

(Optional Components)

The grease composition of the present embodiment may further comprise optional components in a range that does not undermine the effects of the present embodiment. Examples of the optional components include an abrasion-resistant agent, an antioxidant, an extreme pressure additive, dye, a color phase stabilizer, a structure stabilizer, a metal deactivator, an antioxidant, a viscosity index improver, and the like.

When the grease composition comprises the abrasion-resistant agent, examples of the abrasion-resistant agent include methylenebisdithiocarbamate, a sulfur-based abrasion-resistant agent, a phosphorus-based abrasion-resistant agent, and the like. As the abrasion-resistant agent, any one of the above-exemplified abrasion-resistant agents may be used alone, or two or more thereof may be used in combination. In addition, the grease composition of the present embodiment can exhibit good abrasion resistance even when it comprises no abrasion-resistant agents. Examples of the phosphorus-based abrasion-resistant agent include phosphites represented by tributyl phosphite and trioleyl phosphite; phosphates represented by tricresidyl phosphate and dilauryl acid phosphate; amine phosphates represented by dibutyl octylamine phosphate and dilauryloctylamine phosphate, etc.; phosphorothionates represented by triphenylphosphorothionate and alkylated phosphorothioteate, etc.; solid lubricants represented by calcium phosphate; and diphenyl hydrogen phosphite, etc.

When the grease composition comprises the abrasion-resistant agent, the content thereof is not particularly limited. By way of an example, the content of the abrasion-resistant agent is preferably 0.1% by mass or more, and more preferably 0.5% by mass or more in the grease composition. In addition, the content of the abrasion-resistant agent is preferably 5% by mass or less, and more preferably 3% by mass or less. When the content of the abrasion-resistant agent is within the above-described ranges, the grease composition obtained can have a good abrasion resistance.

When the grease composition comprises the antioxidant, examples of the antioxidant include an amine-based antioxidant and the like. The amine-based antioxidant is preferably an aromatic amine compound. Examples of the aromatic amine compound include diphenylamine, alkylated diphenylamine, phenothiazine, N-phenyl-α-naphthylamine, p, p'-diaminodiphenylmethane, aldol-α-naphthylamine, p-dodecylphenyl-1-naphthylamine, and the like.

When the grease composition comprises the antioxidant, the content thereof is not particularly limited. By way of an example, the content of the antioxidant is preferably 0.1% by mass or more, and more preferably 0.5% by mass or more in the grease composition. The content of the antioxidant is preferably 5% by mass or less, and more preferably 3% by mass or less. When the content of the antioxidant is within the above-described ranges, the grease composition obtained can have a good oxidative stability.

When the grease composition comprises the extreme pressure additive examples of the extreme pressure additive include molybdenum dithiocarbamate, molybdenum dithiophosphate, thiophosphate ester, a sulfurized oil and fat, dibenzyl sulfide, dibutyl disulfide, and the like. Among them, the sulfurized oil and fat is preferable. As the extreme pressure additive, any one of the above-exemplified extreme pressure additives may be used alone, or two or more thereof may be used in combination.

When the grease composition comprises the extreme pressure additive, the content thereof is not particularly limited. By way of an example, the content of the extreme pressure additive is preferably 0.1% by mass or more, and more preferably 0.5% by mass or more in the grease composition. The content of the extreme pressure additive is preferably 5% by mass or less, and more preferably 3% by mass or less. When the content of the extreme pressure additive is within the above-described ranges, the grease composition obtained can have a good load resistance.

The grease composition according to the present embodiment has a low bioaccumulativity even when accidentally leaked to the ocean or river, and is safe for a human body. Further, it has rust prevention, water resistance, water repellency, and adhesiveness that are comparable to or higher than an industrial lubricant, and can be used outdoors, etc. In particular, since it has a good rust prevention and water resistance against salt water such as sea water, it is appropriately used for a wire rope that comes into contact with water, such as those used for raising and lowering a gate of a sluice and for ships. In addition, the grease composition comprising a thickener is in particular appropriately used for maintenance, and the grease composition comprising a biodegradable wax and a tackiness agent is in particular appropriately used for initial filling of a wire rope production line.

EXAMPLE

Hereinafter, the present invention will be described more specifically with reference to Examples. The present invention is in no way limited to these Examples.

Hereinafter, various materials used in Examples and Comparative examples are collectively shown.

Synthetic ester oil: Synative ES TMP 05/320 (trimethylol propane complex ester, kinematic viscosity (40° C.): 326 $mm^2/s$) manufactured by BASF Japan Ltd.

Vegetable oil: Castor Oil No.1 (kinematic viscosity (40° C.): 240 $mm^2/s$) manufactured by Hokoku Corporation Wax: Paraffin Wax 155F manufactured by Nippon Seiro Co., Ltd.

Lithium soap: a lithium soap formed by reaction of hydroxystearic acid and 12-hydroxystearic acid with lithium hydroxide Lithium complex soap: a lithium complex soap formed by reaction of a mixture of 12-hydroxystearic acid and azelaic acid with lithium hydroxide Diurea compound: a diurea compound formed by reaction of a mixture of cyclohexylamine and stearylamine with 4,4'-diphenylmethane diisocyanate Tackiness agent: Idemitsu Polybutene 2000H manufactured by Idemitsu Kosari Co., Ltd.

Calcium sulfonate complex: Daphne Multilex WR manufactured by Idemitsu Kosan. Co., Ltd.

Sorbitan fatty acid ester 1: Emazol 0-10V sorbitan monooleate) manufactured by Kao Corporation Sorbitan fatty acid ester 2: Emazol 0-30V (sorbitan trioleate) manufactured by Kao Corporation

Examples 1 to 10 and Comparative Examples 1 to 5

A grease composition was prepared according to the formulation shown in Table 1. The obtained grease composition was evaluated as follows. The evaluation results are shown in Table 1.

<Measurement of Worked Penetration>

A value of the worked penetration was determined by measuring a depth (mm) reached by dropping a cone attached to a penetration meter into a grease composition for testing and penetrating it therethrough for 5 seconds under the environment of 25° C. according to JIS K 2220 7 and multiplying the measured value by 10.

<Neutral Salt Water Spray Test>

A rust generation rate after storing a test piece coated with a grease composition for testing (the coating method conforms to JIS K 2220 21) in an apparatus sprayed with neutral salt water for a specified time under an environment of 35° C. was examined conforming to JIS K 2246 6.35. Table 1 shows spraying time of salt water where the rust generation rate was 0%. 120 hours or more shall be a performance target value.

<Water Washing Resistance Test>

A mass of grease washed out with water relative to the amount of grease of 100% by mass before testing was measured under environments of 38° C. and 79° C., conforming to JIS K 2220 16. The smaller the mass is, the better the water resistance is.

<Oil Separation Degree>

Oil separation degree when the grease composition was left to stand for 24 hours at 100° C. was measured conforming to JIS K 2220 11. The smaller the mass is, the better the storage stability is.

TABLE 1

| | | Example | | | | | | | | | |
|---|---|---|---|---|---|---|---|---|---|---|---|
| | | 1 | 2 | 3 | 4 | 5 | 6 | 7 | 8 | 9 | 10 |
| | Synthetic ester oil | 87 | 87 | 87 | 85.5 | 65 | 65 | 70 | 66.5 | 63 | 65 |
| | Vegetable oil | — | — | — | — | 20.5 | 20.5 | — | — | 20.5 | 20.5 |
| | Lithium soap | 10 | 10 | 10 | 10 | 10 | 10 | 15 | 8.0 | — | — |
| | Lithium composite soap | — | — | — | — | — | — | — | — | 12 | — |
| | Diurea compound | — | — | — | — | — | — | — | — | — | 10 |
| | Calcium sulfonate complex | 1.5 | 1.5 | 2.0 | 3.0 | 3.0 | 3.0 | 10 | 17 | 3.0 | 3.0 |
| | Sorbitan fatty acid ester 1 | 1.5 | — | 1.0 | 1.5 | 1.5 | — | 5.0 | 8.5 | 1.5 | 1.5 |
| | Sorbitan fatty acid ester 2 | — | 1.5 | — | — | — | 1.5 | — | — | — | — |
| | Total | 100 | 100 | 100 | 100 | 100 | 100 | 100 | 100 | 100 | 100 |
| | Content of biodegradable substance | 88.5 | 88.5 | 88 | 87 | 87 | 87 | 75 | 75 | 85 | 87 |
| Evaluation | Worked penetration (25° C.) | 275 | 275 | 275 | 280 | 280 | 280 | 240 | 285 | 280 | 290 |
| | Salt water spray test (h) | 120 | 120 | 144 | 300 or more | 300 or more | 300 or more | 300 or more | 300 or more | 300 or more | 120 |
| | Water washing resistance (38° C., 1 h) (% by mass) | 2 | 2 | 1 | 1 | 1 | 1 | 1 | 1 | 3 | 1 |
| | Water washing resistance (79° C., 1 h) (% by mass) | 4 | 4 | 3 | 3 | 3 | 3 | 1 | 3 | 4 | 2 |
| | Oil separation degree (100° C., 24 h) (% by mass) | 0.8 | 0.8 | 0.8 | 0.7 | 0.7 | 0.7 | 0.5 | 0.9 | 0.8 | 0.5 |

TABLE 1-continued

| | | Comparative example | | | | |
|---|---|---|---|---|---|---|
| | | 1 | 2 | 3 | 4 | 5 |
| Synthetic ester oil | | 65.5 | 88 | 64 | 87 | 87 |
| Vegetable oil | | — | — | — | — | — |
| Lithium soap | | 9.0 | 10 | 15 | 10 | 10 |
| Lithium composite soap | | — | — | — | — | — |
| Diurea compound | | — | — | — | — | — |
| Calcium sulfonate complex | | 17 | 1.0 | 10.5 | 3.0 | — |
| Sorbitan fatty acid ester 1 | | — | — | — | — | 3.0 |
| Sorbitan fatty acid ester 2 | | 8.5 | 1.0 | 10.5 | — | — |
| Total | | 100 | 100 | 100 | 100 | 100 |
| Content of biodegradable substance | | 74 | 89 | 74.5 | 87 | 90 |
| Evaluation | Worked penetration (25° C.) | 285 | 285 | 240 | 275 | 280 |
| | Salt water spray test (h) | 300 or more | 72 | 120 or more | 72 | 48 |
| | Water washing resistance (38° C., 1 h) (% by mass) | 1 | 1 | 1 | 1 | 3 |
| | Water washing resistance (79° C., 1 h) (% by mass) | 3 | 4 | 2 | 4 | 6 |
| | Oil separation degree (100° C., 24 h) (% by mass) | 0.9 | 0.9 | 0.5 | 0.6 | 0.8 |

From the results shown in Table 1, it can be seen that the grease composition of the present invention has good rust prevention, water resistance, and storage stability against salt water.

Examples 11 to 17 and Comparative Examples 6 to 10

A grease composition was prepared according to the formulation shown in Table 2. The obtained grease composition was evaluated as follows. The evaluation results are shown in Table 2.

<Measurement of Melting Point>

A melting point of the grease composition was measured conforming to JIS K 2235.

<Neutral Salt Water Spray Test>

A rust generation rate after storing a test piece coated with a grease composition for testing (the coating method conforms to JIS K 2220 21) in an apparatus sprayed with neutral salt water for a specified time under an environment of 35° C. was examined conforming to JIS K 2246 6.35. Table 2 shows spraying time of salt water where the rust generation rate was 0%. 240 hours or more shall be a performance target value.

From the results shown in Table 2, it can be seen that the grease composition of the present invention has a good rust prevention against salt water.

INDUSTRIAL APPLICABILITY

The grease composition of the present invention has little influence on the environment and has good rust prevention and water resistance against salt water such as sea water, and thus it is useful particularly as a lubricant for a wire rope that comes into contact with water.

The invention claimed is:

1. A grease composition, comprising:

a biodegradable base oil, a thickener, and a rust-preventive agent, which is a calcium sulfonate complex and a sorbitan fatty acid ester, wherein the biodegradable base oil comprises one or more selected from the group consisting of a synthetic ester oil and a vegetable oil, wherein a total content of biodegradable organic substances in the grease composition is 75% by mass or more, a content of the rust-preventive agent is 4.5 to 20% by mass,

TABLE 2

| | | Example | | | | | | | Comparative example | | | | |
|---|---|---|---|---|---|---|---|---|---|---|---|---|---|
| | | 11 | 12 | 13 | 14 | 15 | 16 | 17 | 6 | 7 | 8 | 9 | 10 |
| Synthetic ester oil | | 77 | 77 | 75.5 | 67 | 62.5 | 67 | 81 | 82 | 61.5 | 56 | 78.5 | 78.5 |
| Wax | | 10 | 10 | 10 | 10 | 10 | 20 | 6.0 | 5.0 | 10 | 10 | 10 | 10 |
| Tackiness agent | | 10 | 10 | 10 | 20 | 5.0 | 10 | 15 | 10 | 25.5 | 10 | 10 | 10 |
| Calcium sulfonate complex | | 1.5 | 1.5 | 3.0 | 1.5 | 1.5 | 1.5 | 1.5 | 1.5 | 1.5 | 16 | — | 3.0 |
| Sorbitan fatty acid ester 1 | | 1.5 | — | 1.5 | 1.5 | 1.5 | 1.5 | 1.5 | 1.5 | 1.5 | 8.0 | 3.0 | — |
| Sorbitan fatty acid ester 2 | | — | 1.5 | — | — | — | — | — | — | — | — | — | — |
| Total | | 100 | 100 | 100 | 100 | 100 | 100 | 100 | 100 | 100 | 100 | 100 | 100 |
| Content of biodegradable substance | | 88.5 | 88.5 | 87 | 78.5 | 80 | 87 | 88.5 | 88.5 | 74.5 | 74 | 90 | 88.5 |
| Evaluation | Melting Point (° C.) | 75 | 75 | 77 | 78 | 82 | 82 | 52 | 48 | 85 | 92 | 72 | 72 |
| | Salt water spray test (h) | 300 or more | 300 or more | 300 or more | 300 or more | 300 or more | 300 or more | 264 or more | 240 or more | 300 or more | 300 or more | 240 or more | 240 or more |

a content of the calcium sulfonate complex with respect to the sorbitan fatty acid ester (a content of the calcium sulfonate complex/a content of the sorbitan fatty acid ester) is 0.5 to 5.0, the thickener is one or more selected from the group consisting of a lithium soap, a urea-based compound, and a lithium composite soap and a content of the thickener is 5.0 to 20% by mass, a worked penetration of the grease composition is 220 to 340, the biodegradable organic substance is one or more selected from the group consisting of a base oil, a sorbitan fatty acid ester, an ester-based rust-preventive agent, a wax, and a tackiness agent, and the biodegradable organic substances have a biodegradability of 60% or more by, microorganisms, conforming to the OECD test guideline 301B.

2. The grease composition of claim 1, wherein a worked penetration of the grease composition is 265 to 295.

3. A grease composition, comprising:

a biodegradable base oil, a biodegradable wax, a tackiness agent, and a rust-preventive agent, which is a calcium sulfonate complex and a sorbitan fatty acid ester, wherein the biodegradable base oil comprises one or more selected from the group consisting of a synthetic ester oil and a vegetable oil, wherein a total content of biodegradable organic substances in the grease composition is 75% by mass or more, a content of the rust-preventive agent is 4.5 to 20% by mass, a content of the calcium sulfonate complex with respect to the sorbitan fatty acid ester (a content of the calcium sulfonate complex/a content of the sorbitan fatty acid ester) is 0.5 to 5.0, the wax is one or more selected from the group consisting of a rice wax, a carnauba wax, a candelilla wax, a microcrystalline wax, and a paraffin wax, a content of the biodegradable wax in a total amount of the biodegradable base oil and the biodegradable wax is 6.0 to 40% by mass, a content of the tackiness agent is 1.0 to 25% by mass, the biodegradable organic substance is one or more selected from the group consisting of a base oil, a sorbitan fatty acid ester, an ester-based rust-preventive agent, a wax, and a tackiness agent, and the biodegradable organic substances have a biodegradability of 60% of more by microorganisms, conforming to the OECD test guideline 301B, and a melting point of the grease composition is 50° C. to 100° C.

4. The grease composition of claim 3, wherein the tackiness agent is one or more selected from the group consisting of a polybutene, a polyisobutylene, and an alpha-olefin copolymer.

5. The grease composition of claim 3, wherein a content of a thickener is less than 1.0% by mass.

6. The grease composition of claim 1, wherein:

the calcium sulfonate complex comprises calcium sulfonate and calcium carbonate as essential components, and further comprises at least two selected from the group consisting of calcium dibehenate, calcium distearate, calcium dihydroxystearate, calcium borate and calcium acetate compounded with the calcium sulfonate and the calcium carbonate.

7. The grease composition of claim 1, wherein:

the sorbitan fatty acid ester comprises one or more selected from the group consisting of sorbitan monooleate and sorbitan trioleate.

8. The grease composition of claim 1, wherein:

the content of the calcium sulfonate complex with respect to the sorbitan fatty acid ester (a content of the calcium sulfonate complex/a content of the sorbitan fatty acid ester) is 0.7 to 3.0.

9. The grease composition of claim 3, wherein:

the calcium sulfonate complex comprises calcium sulfonate and calcium carbonate as essential components, and further comprises at least two selected from the group consisting of calcium dibehenate, calcium distearate, calcium dihydroxystearate, calcium borate and calcium acetate compounded with the calcium sulfonate and the calcium carbonate.

10. The grease composition of claim 3, wherein:

the sorbitan fatty acid ester comprises one or more selected from the group consisting of sorbitan monooleate and sorbitan trioleate.

11. The grease composition of claim 3, wherein:

the content of the calcium sulfonate complex with respect to the sorbitan fatty acid ester (a content of the calcium sulfonate complex/a content of the sorbitan fatty acid ester) is 0.7 to 3.0.

* * * * *